US005809797A

United States Patent [19]

Ryu

[11] Patent Number: 5,809,797

[45] **Date of Patent: *Sep. 22, 1998**

[54] ICE CUBE TRAY ASSEMBLY FOR REFRIGERATORS

[75] Inventor: Sang Chul Ryu, Suwon, Rep. of Korea

[73] Assignee: Samsung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 718,700

[22] Filed: Sep. 27, 1996

[30] Foreign Application Priority Data

Dec. 29, 1995 [KR] Rep. of Korea ..... 95-65560

[51] Int. Cl.[6] ..... F25C 1/10

[52] U.S. Cl. ..... 62/340

[58] Field of Search ..... 384/295, 296, 384/416, 428, 439, 539; 62/340

[56] References Cited

U.S. PATENT DOCUMENTS

| | | | |
|---|---|---|---|
| 805,891 | 11/1905 | Stanley | 384/416 |
| 833,707 | 10/1906 | Corcoran | 384/416 |
| 1,133,634 | 3/1915 | Gushurst | 384/428 |
| 4,795,926 | 1/1989 | Someya et al. | 384/439 |
| 4,806,024 | 2/1989 | Tanaka et al. | 384/539 |
| 4,967,995 | 11/1990 | Burgess | 249/70 |
| 5,253,487 | 10/1993 | Oike | 62/353 |

*Primary Examiner*—William E. Tapolcai
*Attorney, Agent, or Firm*—Burns, Doane, Swecker & Mathis, L.L.P.

[57] ABSTRACT

An ice cube tray assembly for refrigerators, which prevents an undesirable separation of the ice cube tray from the tray case when the tray is rotated, is disclosed. The tray assembly of this invention has a tray case, which is slidably installed in a base of a freezer compartment of a refrigerator and has a bearing with a snap lip. An ice cube tray is rotatably mounted to the case by a hinge pin snapping into the bearing. A stopper is provided on the bearing for preventing an undesirable separation of the hinge pin from the bearing when the tray is rotated. The tray assembly is thus free from any locking device used for preventing separation of the tray so that the assembly has a simple construction, improves work efficiency while assembling the tray assembly, and improves the operational reliability of the refrigerators.

1 Claim, 4 Drawing Sheets

FIG. 3A
(PRIOR ART)
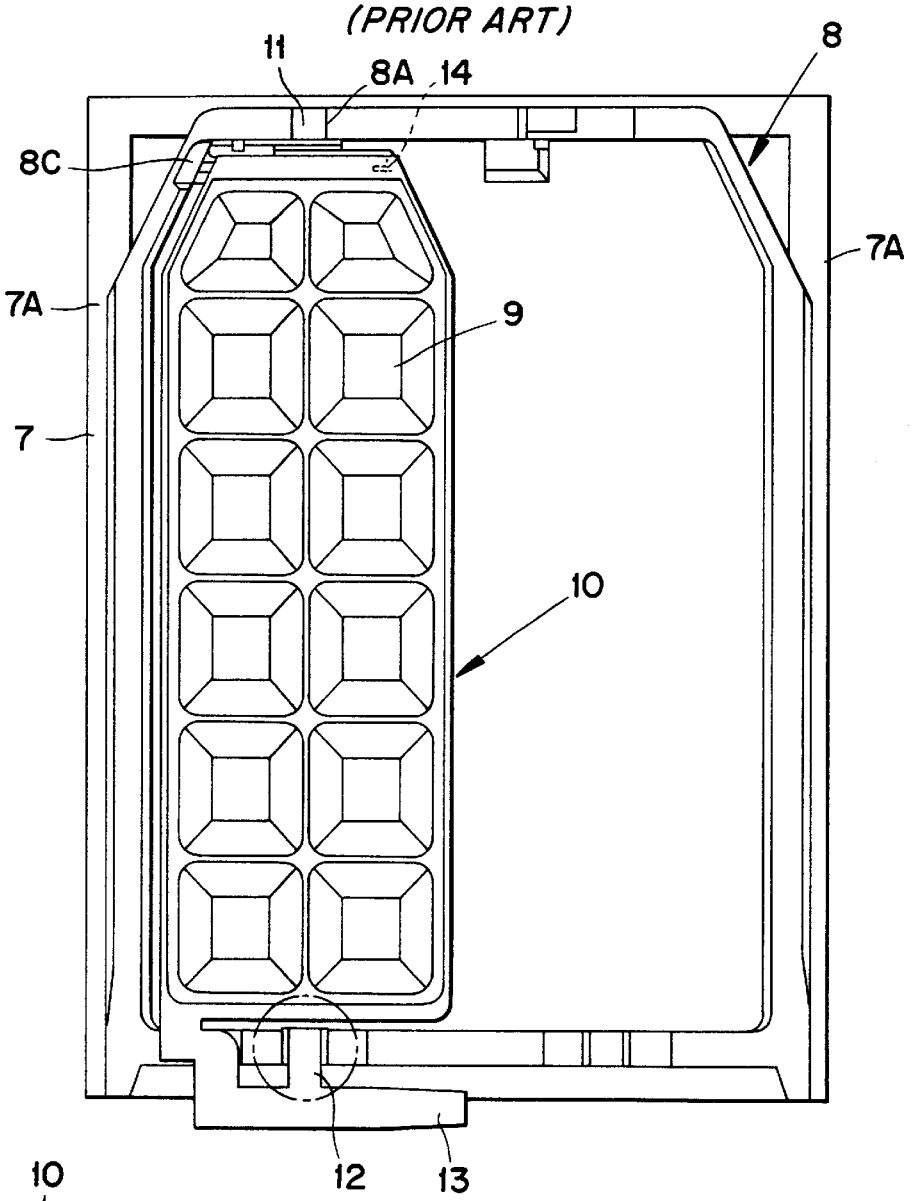
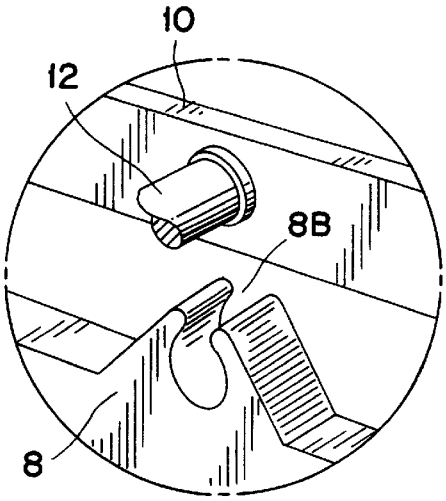
FIG. 3B
(PRIOR ART)

ICE CUBE TRAY ASSEMBLY FOR REFRIGERATORS

BACKGROUND OF THE INVENTION

1. Field of the Invention

The present invention relates, in general, to an ice cube tray assembly for refrigerators.

2. Description of the Prior Art

A typical refrigerating system for refrigerators is schematically shown in FIG. 1. As shown in the drawing, the typical refrigerating system includes a compressor 4, which receives low temperature and low pressure refrigerant gas through a suction pipe 1 and compresses the refrigerant gas in order to provide high temperature and pressurized refrigerant gas and supplies the pressurized hot refrigerant gas to a condenser 3. The above refrigerating system also includes a capillary tube 5, wherein the pressurized hot refrigerant gas emits heat to the atmospheric air so that the refrigerant gas is condensed and becomes liquid refrigerant. The refrigerating system further includes an evaporator 6, wherein the low temperature liquid refrigerant absorbs heat from air thus cooling the air. The cold air generated by the evaporator 6 is distributed into the freezer and refrigeration compartments of a refrigerator by a blower.

The cold air generated by the evaporator of the above refrigerating system is sucked into the freezer and refrigeration compartments by the suction force of a fan and repeatedly circulates inside the compartments. The fan is exclusively turned on when freezer thermostat, which automatically controls the temperature inside the freezer compartment, is actuated.

FIG. 2 shows the construction of a conventional refrigerator. As shown in FIG. 2, the conventional refrigerator includes a freezer compartment 21, which is typically formed inside the cabinet or housing at a position the evaporator 6. In the above freezer compartment 21, a base 7 and a food holding shelf 11 are installed. In addition, three compartments, that is, a vegetable compartment 22, a fresh food compartment 23 and a refrigeration compartment 24, are formed inside the cabinet under the evaporator 6. The vegetable and fresh food compartments 22 and 23 are provided inside the refrigeration compartment 24. Each of the vegetable and fresh food compartments 22 and 23 maintains the appropriate temperature and an appropriate percentage of humidity and thereby maintains the freshness of food, which is stored in the compartment, for a lengthy period of time. A plurality of shelves 29 are provided in the refrigeration compartment 24.

A part of the cold air, which is sucked from the evaporator 6 by the suction force of a motor fan 25, is introduced into the freezer compartment 21 through a passage bordered by an inner wall or cabinet 26 of the freezer compartment 21. The fan 25 is operated by a freezer thermostat (not shown), which automatically controls the temperature inside the freezer compartment 21. The other part of the cold air from the evaporator 6 is introduced into the refrigeration compartment 24 through a passage bordered by an inner wall or cabinet 28 of the refrigeration compartment 24. In this case, the amount of cold air introduced into the refrigeration compartment 24 is regulated by a damper 27, which is installed at a predetermined position inside the compartment 24.

U.S. Pat. No. 4,967,995 disclosed an ice cube tray assembly suitable for allowing the formed ice cubes to be easily dispensed from the ice cube tray.

In the tray assembly of that patent, a cover, which has a structure suitable for easy removal of the formed ice cubes from the ice cube tray, covers the top of the tray so that the formed ice cubes can be manually dispensed from the tray. However, the tray assembly has a problem in that it must be removed from the freezer compartment and the tray must be uncovered prior to dispensing the formed ice cubes from the tray. The assembly is thus inconvenient to the users.

A device for rotating the ice cube tray in an automatic ice maker has been disclosed in U.S. Pat. No. 5,253,487.

FIGS. 3A and 3B shows the construction of a conventional ice cube tray assembly for refrigerators. As shown, a base 7 is installed in a corner of the freezer compartment. The base 7 includes a slidable case 8, which is held on guide rails 7A of the base 7 so that the case 8 can slide forward and backward inside the base 7. An ice cube tray 10 with a plurality of individual ice cube compartments 9 is pivotally mounted in the upper portion of the case 8 so that the tray 10 can be rotated relative to the case 8. The compartments 9 have an equal depth and are arranged in two rows along the length of the tray 10. In the above tray assembly, a first hinge pin 11, which longitudinally extends from one end of the tray 10, is rotatably received in a connecting hole 8A of the case 8. In order to bias the tray 10 to its original position, the tray assembly also includes an elastic member or a coiled torsion spring 14, which is fitted over the first hinge pin 11. Both ends of the torsion spring 14 are caught by a stop shoulder 8C of the case 8 and the body of the tray 10, respectively. The stop shoulder 8C is also brought into contact with either side of the tray 10 thus limiting the rotating range of the tray 10. A second hinge pin 12, which longitudinally extends from the other end of the tray 10, is detachably snapped into and held by an upwardly open slot forming a bearing 8B of the case 8. The above bearing 8B opens on its top in order to form a snap lip which allows the second pin 12 to be snapped into the bearing 8B. The tray 10 also has a finger-operable knob 13, which is integrated with both the body of the tray 10 and the second pin 12 into a single body.

In order to remove and dispense the formed ice cubes from the compartments 9 of the tray 10, the tray 10 is rotated clockwise in FIG. 3B about a common axis of the hinge pins 11 and 12 by manually rotating the knob 13. In this case, as the second pin 12 is only snapped into the bearing 8B the pin 12 may undesirably come out of the bearing 8B thereby separating the tray 10 from the case 8 when the knob 13 is rotated with excessive torque when dispensing the formed ice cubes. In this regard, the tray assembly is inconvenient to users. In order to prevent such an undesirable separation of the tray 10 from the case 8, a locking device must be provided in the tray assembly. However, the locking device results in an increase of the number of elements of the tray assembly. The tray assembly with the locking device thus has a complicated construction, reducing work efficiency while assembling the tray assembly.

SUMMARY OF THE INVENTION

It is, therefore, an object of the present invention to provide a structurally-improved ice cube tray assembly for refrigerators in which the above problems can be overcome and which prevents an undesirable separation of the ice cube tray from the tray case when the tray is rotated in order to remove and dispense the formed ice cubes from the tray.

In order to accomplish the above object, an ice cube tray assembly for refrigerators in accordance with the preferred embodiment of the invention comprises a tray case slidably installed in a base of a freezer compartment of a refrigerator and having a bearing with a snap lip, an ice cube tray rotatably mounted to the tray case by an integral knob/hinge pin snapped into the bearing of the case, and a stopper provided on the bearing for preventing an undesirable separation of the hinge pin from the bearing when the tray is rotated.

BRIEF DESCRIPTION OF THE DRAWINGS

The above and other objects, features and other advantages of the present invention will be more clearly understood from the following detailed description taken in conjunction with the accompanying drawings, in which:

FIG. 3A is a plan view showing the construction of a typical ice cube tray assembly;

FIG. 3B is a fragmentary perspective view of the assembly shown in FIG. 3A;

FIGS. 6A and 6B depict the insertion of a hinge pin of an ice cube tray into a mounting slot.

DESCRIPTION OF THE PREFERRED EMBODIMENTS

Figure 1:
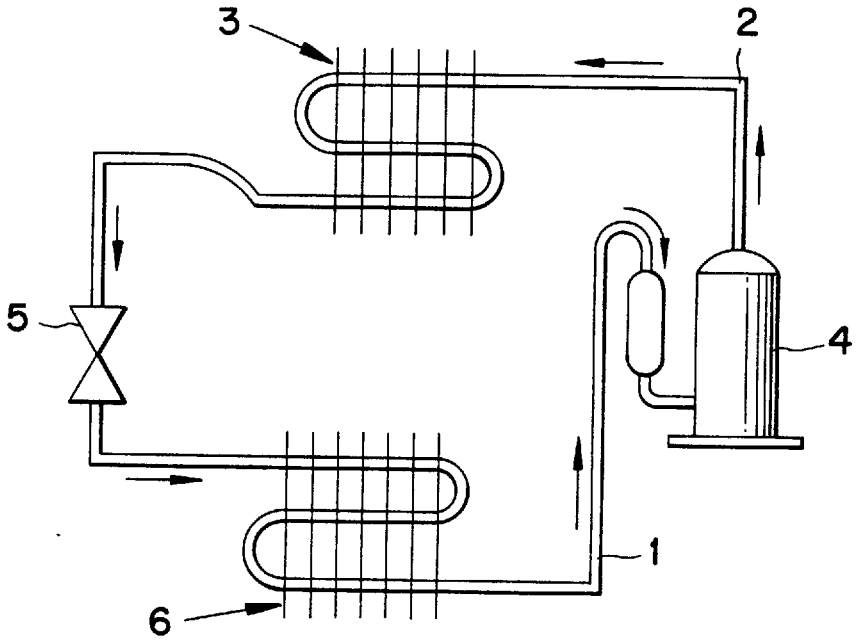
FIG. 1 is a schematic diagram showing the construction of a typical refrigerating system for refrigerators.
Figure 5:
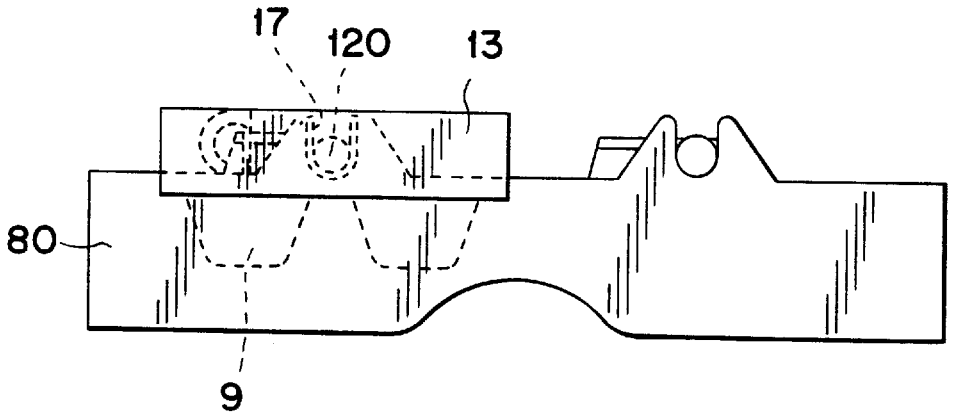
FIG. 5 is a side view of the ice cube tray assembly of the present invention.
Figure 2:
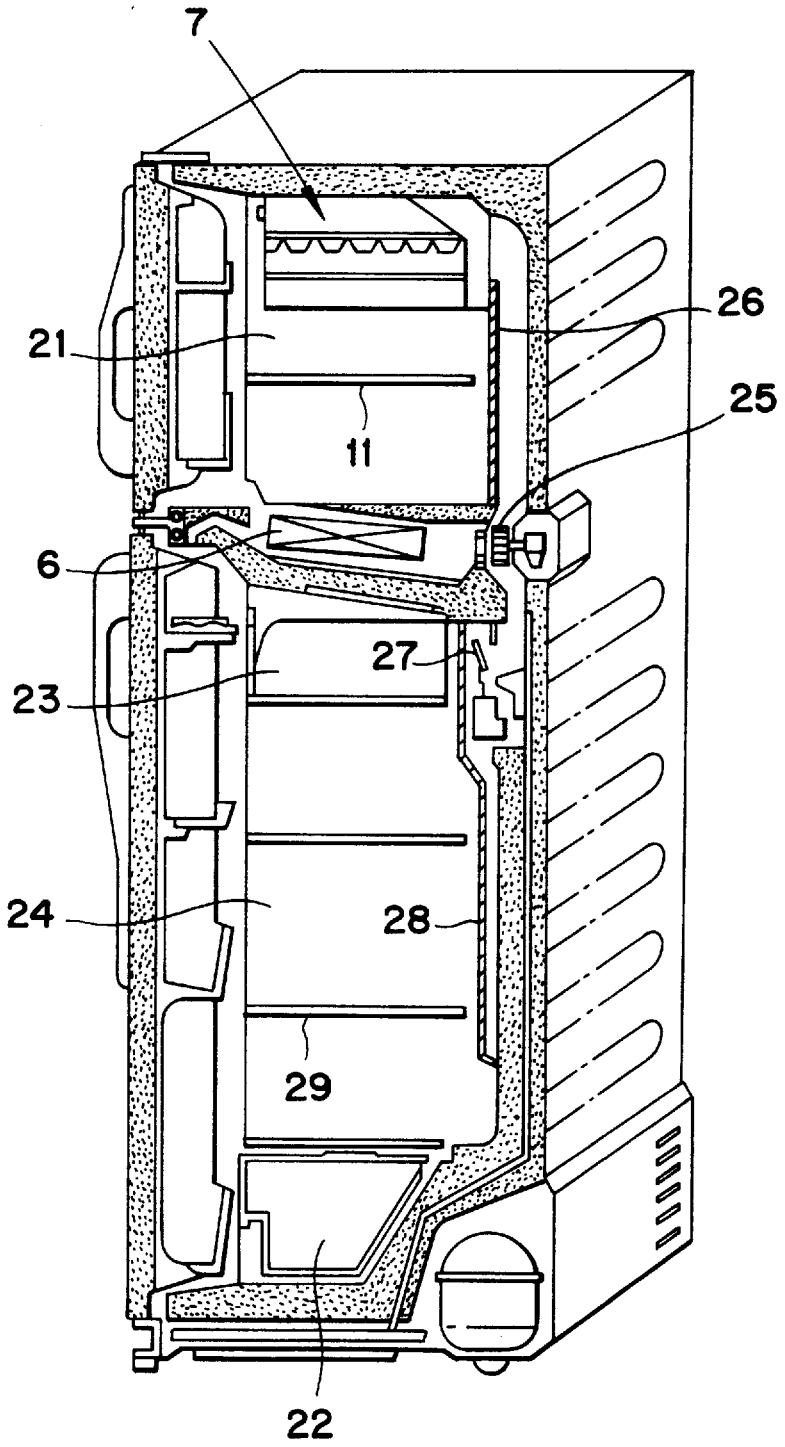
FIG. 2 PRIOR ART
FIG. 2 is a perspective view showing the construction of a conventional refrigerator.
Figure 4A:
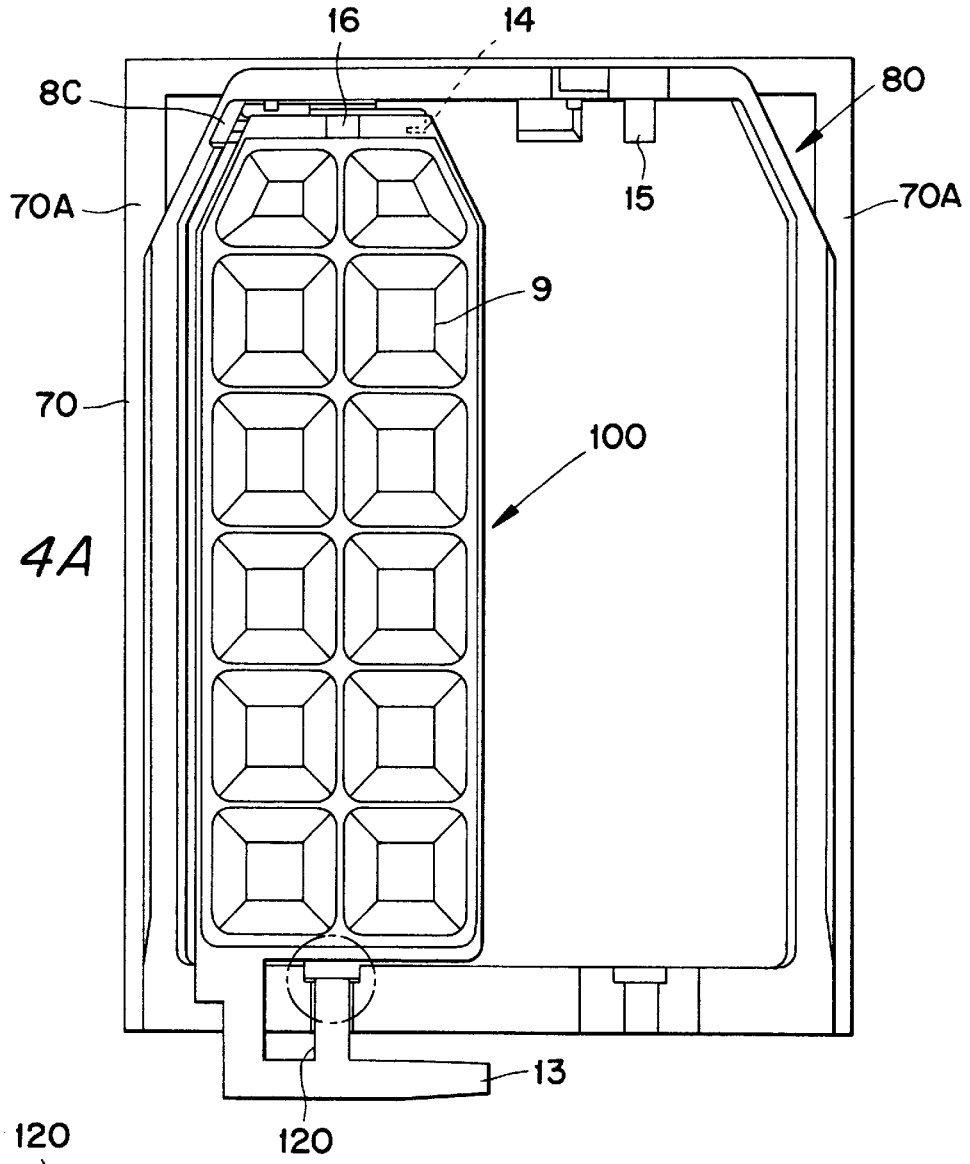
FIG. 4A is a plan view showing the construction of an ice cube tray assembly in accordance with the preferred embodiment of the present invention.
Figure 4B:
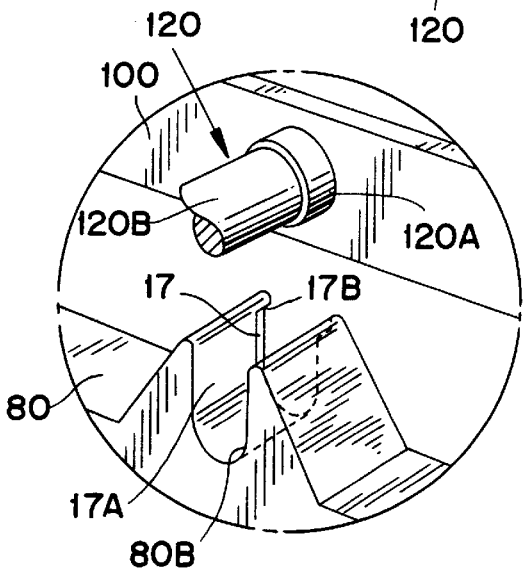
FIG. 4B is a fragmentary perspective view of the assembly shown in FIG. 4B.

FIGS. 4A and 4B show the construction of the ice cube tray assembly in accordance with the preferred embodiment of the present invention. FIG. 5 is a front view of the ice cube tray assembly.

As shown, a base 70 is installed in a corner of the freezer compartment. The base 70 includes a slidable case 80, which is held on guide rails 70A of the base 7 so that the case 80 can slide forward and backward inside the base 70. An ice cube tray 100 with a plurality of individual ice cube compartments 9 is pivotally mounted in the upper portion of the case 80 so that the tray 100 can be rotated relative to the case 80. In the tray assembly, a first hinge pin 15, which integrally extends from the case 80, rotatably engages with a connecting hole 16 of the tray 100. The connecting hole 16 of the tray 100 is formed on one end of the tray. In order to bias the tray 100 to its original position, the tray assembly also includes an elastic member or a coiled torsion spring 14, which is fitted over the first hinge pin 15. Both ends of the torsion spring 14 are caught by a stop shoulder 8C of the case 80 and the body of the tray 100, respectively.

A second hinge pin 120, which longitudinally extends from the other end of the tray 100, is detachably snapped into and held by an upwardly open slot forming bearing 80B of the case 80. The above bearing 80B opens on its top in order to form a snap lip which allows the second pin 120 to be snapped into the bearing 80B. The tray 100 also has a finger-operable knob 13, which is integrated with both the body of the tray 100 and the second pin 120 into a single body. The second hinge pin 120 has a first cylindrical portion 120B and a second cylindrical portion 120A forming a protrusion, while a portion 17 of the bearing surface of the bearing 80B is and terminates short of an upper portion of the slot to form a pair of stopper surfaces 17B which are disposed on opposite sides of the slot and face generally downwardly. The stopper surfaces 17B overlie and engage recessed relative to another portion 17A of the bearing surface the protrusion 120A of the pin 120 thus preventing an undesirable separation of the pin 120 from the bearing 80B when the tray 100 is rotated.

The operational effect of the above ice cube tray assembly will be described hereinbelow.

In order to remove and dispense the formed ice cubes from the compartments 9 of the tray 100, the tray 100 is rotated clockwise in FIG. 5 about the hinge pins 120 and 15 by manually rotating the knob 13. When the tray 100 has been rotated at an angle of 180°, the tray 100 is brought into contact with the stop shoulder 8C of the case 80. The tray 100 in the above state is thus distorted when torque is continuously applied to the knob 13. The formed ice cubes are thus removed and dispensed from the compartments 9 of the tray 100 and are dropped into the ice bin (not shown). The ice bin, which contains the formed ice cubes dispensed from the tray 100, is slidably mounted to the base 70 at a position under the tray 80.

In the above ice cube tray assembly, the protrusion 120A of the second hinge pin 120 engages with the stopper 17 of the bearing 80B so to prevent an undesirable separation of the pin 120 from the bearing 80B when the tray 100 is rotated in order to remove and dispense the formed ice cubes from the compartments 9.

As described above, the present invention provides an ice cube tray assembly for refrigerators which prevents an undesirable separation of the ice cube tray from the tray case when the tray is rotated in order to remove and dispense the formed ice cubes from the tray. The tray assembly of this invention is thus free from any locking device used for preventing separation of the tray so that the assembly has a simple construction, improves work efficiency while assembling the tray assembly, and improves the operational reliability of the refrigerators.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An ice cube tray assembly for refrigerators, comprising:

a base adapted to be mounted in a freezer compartment of a refrigerator;

a tray case slidably installed in the base and forming an upwardly open slot, the slot including a bearing surface having first and second cylindrical portions, the first portion extending to an uppermost portion of the slot the second portion being recessed with respect to the first portion and terminating short of the uppermost portion of the slot; and an ice cube tray detachably mounted to the case for rotation about an axis, the tray including a hinge pin defining the axis, the hinge pin being integral with a manually rotatable actuating knob and including first and second cylindrical portions, respectively, the second portion being of larger diameter than the first portion, the hinge pin being detachably mounted by a snap-fit in the slot, with the first and second portions of the hinge pin disposed in the first and second portions, respectively, of the slot.

* * * * *